US006230755B1

(12) United States Patent
Debaes et al.

(10) Patent No.: US 6,230,755 B1
(45) Date of Patent: May 15, 2001

(54) JACQUARD HEDDLE CONNECTING EYE STRUCTURE

(75) Inventors: Johnny Debaes, Moorslede; Bram Vanderjeught, Ypres, both of (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 0 days.

(21) Appl. No.: 09/453,296

(22) Filed: Dec. 3, 1999

(30) Foreign Application Priority Data

Dec. 4, 1998 (BE) ..... 09800875

(51) Int. Cl.[7] ..... D03C 3/40
(52) U.S. Cl. ..... 139/85; 139/90; 24/130
(58) Field of Search ..... 139/455, 85, 90, 139/82; 140/72; 29/4.6; 24/130

(56) References Cited

U.S. PATENT DOCUMENTS 586,322 * 7/1897 Stafford ..... 139/85
3,834,426 9/1974 Müller .
4,178,661 * 12/1979 Klein ..... 24/130
5,964,698 * 10/1999 Fowler ..... 600/217

FOREIGN PATENT DOCUMENTS 10 74 515 1/1960 (DE) .
23 16 446 10/1974 (DE) .
2 165 827 8/1973 (FR) .
2 759 095 8/1998 (FR) .
1 424 260 2/1976 (GB) .

* cited by examiner

*Primary Examiner*—Andy Falik
(74) *Attorney, Agent, or Firm*—James Creighton Wray; Meera P. Narasimhan

(57) ABSTRACT

A jacquard heddle (1) comprising a connecting eye (2) that forms a free passage (3) for a harness cord (5) and a clamping passage (4) in communication with this free passage (3), whereby the harness cord (5) can be clamped in the clamping passage (4) and can be moved out of the free passage (3) to the clamping passage (4). This jacquard heddle (1) preferably also comprises a fixing sleeve (7), such as for example a shrink sleeve, for the clamped enclosure of the connecting eye (2) and of a part of a harness cord (5) passed around through this connecting eye.

14 Claims, 1 Drawing Sheet

JACQUARD HEDDLE CONNECTING EYE STRUCTURE

Figure 1:
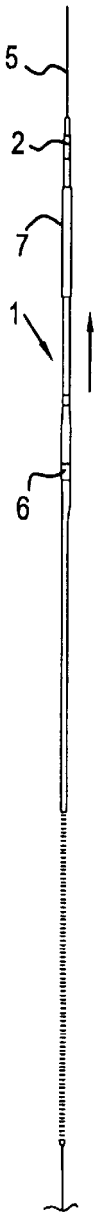

This invention relates a jacquard heddle comprising a connecting eye that forms a free passage for a harness cord.

In order to manufacture fabrics, such as among others jacquard velvet and carpets, on a weaving machine use is made of a jacquard machine in order to bring the various pile warp threads during the successive operating cycles of the weaving machine into the desired positions in relation to the weft thread insertion levels. These positions are e.g. so determined that a number of pile warp threads with different colors form a predetermined figure, design or pattern in the fabric.

Known jacquard machines comprise for that purpose a series of lifting devices consisting of a pair of upwardly and downwardly movable hooks which are selectable in order to remain in a top or a bottom position, and which are provided in order by working together with a tackle device to bring a respective harness cord to different heights. Each harness cord is connected to a jacquard heddle with a heddle eye. Through this heddle eye extend one or several warp threads to be positioned. Hence these pile warp threads can be brought to the desired height by a suitable selection of the hooks during each operating cycle.

Two types of jacquard heddles are utilized, namely the wire type and the flat steel type.

With face-to-face weaving it is usual to provide a series of lancets between the two backing fabrics in order to maintain the pile height as uniform as possible in the whole pile fabric. In this situation whereby the heddles move up and down between the lancets flat steel heddles are more suitable than wire heddles because they are less thick. With the use of wire heddles the heddle eye indeed bumps against the lancets with the upward and downward movements of the jacquard heddle. This causes wear and tear to the heddle eye and to the lancets.

At their top extremity the existing jacquard heddles are provided with a connecting eye for a harness cord. The harness cord is brought through this connecting eye and knotted. In order that the different positions would be the same for all warp threads all jacquard heddles must be properly suspended at the same height. This suspension of the jacquard heddles at the same height on the harness cords, called the levelling of the harness, must therefore be performed with great precision. The uniformity of the levelling is among others dependent on the uniformity with which the various knots are tied. If for example not all knots are pulled equally tight, level differences occur in the harness. If the harness is not properly levelled the shed which is formed between the warp threads during weaving will be imperfect. Because of this pile warp threads of the shed will be in the movement path of the weft insertion means at the moment that the insertion of the weft threads takes place. Because of this pile warp thread breakages will be caused.

The levelling of the harness in the known manner is furthermore also very time-consuming. If corrections have to be made the knots have to be loosened again.

The purpose of this invention is to provide a jacquard heddle which does not have the above mentioned disadvantages, and with which a harness cord can be connected in a simple and quick manner with the required accuracy and efficiency.

This purpose is achieved according to this invention with a jacquard heddle with the characteristics mentioned in the first paragraph of this specification, of which the connecting eye forms a clamping passage in communication with the free passage, while the harness cord can be clamped in the clamping passage.

The connecting of a harness cord to a jacquard heddle according to this invention can now occur in a very fast and simple manner. The harness cord can be pulled through the free passage very smoothly and easily. Thereafter it is sufficient to move the harness cord extending through the connecting eye to the clamping passage in order to accomplish the connection. This makes the connecting of harness cords and jacquard heddles particularly simple and fast to perform. The connection is achieved after the jacquard heddle is brought to the correct levelling height.

The connection is accomplished because of the fact that the harness cord is clamped in the connecting eye. It is therefore no longer necessary to knot the harness cord. The levelling of the harness is greatly simplified because of this, and can also be performed much faster. Furthermore the clamping of a harness cord in a connecting eye can occur with greater accuracy than knotting it. Because of this the harness cord can be levelled better and the number of thread breakages will be reduced. An additional special advantage is that this manner of connecting is very automatisable.

In this patent application and in particular in the claims attached hereto the term jacquard heddle is used in the widest sense of a means connectable to a harness cord which is provided in a jacquard machine for transmitting the movements of that harness cord to one or several threads.

This invention is therefore certainly not restricted to jacquard heddles of the wire type or of the flat steel type alone.

The aforesaid clamping passage is preferably narrower than a transverse dimension of the harness cord.

With a particular embodiment the clamping passage is formed by a slot-shaped part of the connecting eye.

According to a very preferred embodiment of the jacquard heddle according to this invention the connecting eye is made like a slot extending according to the longitudinal direction of the jacquard heddle with two parts of different width which respectively form the free passage and the clamping passage.

With the jacquard heddle put forward according to this invention the clamping passage is preferably provided above the free passage. By pulling the free extremity of the harness cord upward the harness cord can be moved to the clamping passage. This is very easy to perform while the jacquard heddle is held at the desired height.

According to a most preferred embodiment the jacquard heddle comprises a fixing sleeve for the clamped enclosure of the connecting eye and of a part of a harness cord passed around through this connecting eye. This fixing sleeve ensures that the harness cord can not come loose out of the clamping passage.

Such a fixing sleeve can also be utilized with other jacquard heddles than the above described jacquard heddles according to this invention. The known jacquard heddles could also be provided with such a fixing sleeve in order to implement or make more operationally safe the connection to a harness cord extending through the connecting eye.

Another aspect of this invention therefore lies in the special characteristic that a jacquard heddle with a connecting eye (of whatever form) is provided with a fixing sleeve for the clamped enclosure of the connecting eye and a part of a harness cord extending through this connecting eye.

Such a fixing sleeve is very effective and very easy to install if it is a shrink sleeve. By a shrink sleeve is meant, a sleeve which is at least partly made out of a material that can be shrunk after installation of the sleeve, for example by heating that material.

The jacquard heddle according to this invention is preferably of the flat steel type.

This invention also relates to a jacquard machine comprising a number of jacquard heddles with respective connecting eyes, and harness cords which are connected to a respective jacquard heddle and moreover extend through the connecting eye, whereby each connecting eye forms a free passage for a harness cord.

With such known jacquard machines the jacquard heddles are connected to respective harness cords because of the fact that each harness cord extends through a connecting eye and is knotted. The disadvantages linked to this clearly appear from the above.

These disadvantages are according to this invention remedied by providing a jacquard machine of which each of the aforesaid harness cords is clamped in a clamping passage in communication with the free passage.

Such a connection is very simple, can be performed very quickly and accurately, and can furthermore easily be automatized.

If around each jacquard heddle a fixing sleeve is provided which encloses the connecting eye and a part of a harness cord passed around through this connecting eye, the connections between jacquard heddles and harness cords of this jacquard machine are particularly well safeguarded from coming loose.

This invention also relates to a jacquard machine with whatever jacquard heddles with connecting eyes, and irrespective of the form of these connecting eyes, which are provided with a fixing sleeve as described in the preceding paragraph.

In the following two possible embodiments of a jacquard heddle according to this invention are described in detail. This specification only serves to explain the aforesaid characteristics of the invention further, and to specify further properties and distinctive features thereof, and cannot therefore be regarded as a restriction on the protection claimed for this invention in the claims of this patent application.

Figure 2:
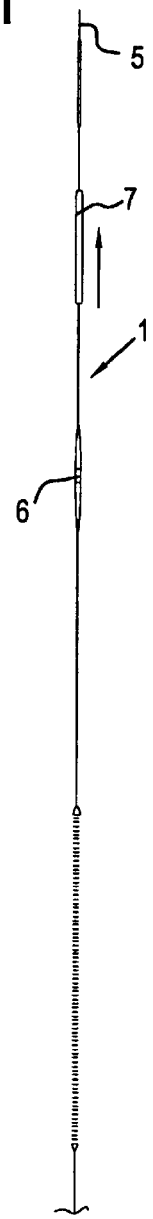
Figure 3:
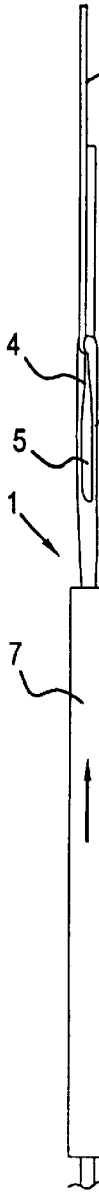
Figure 4:
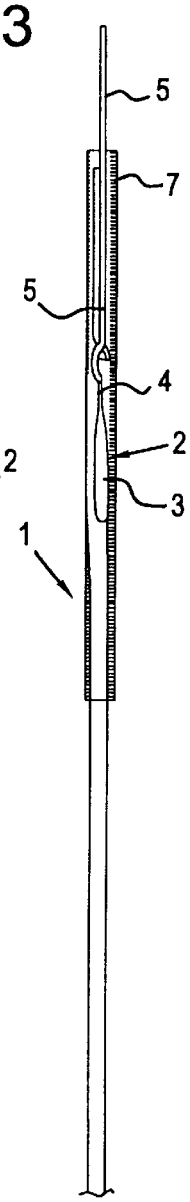
Figure 5:
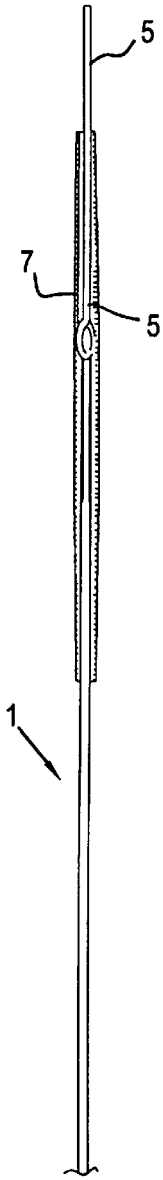
Figure 6:
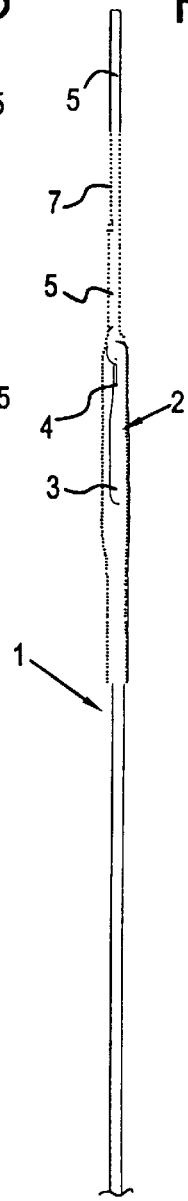
Figure 7:
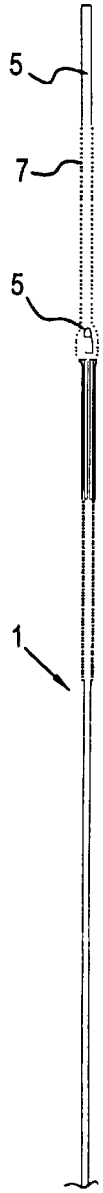

In this specification reference is made by means of reference numbers to the figures attached hereto. Of these figures, FIGS. 1 and 2 show different side views, from mutually perpendicular directions, of a jacquard heddle according to this invention connected to a harness cord, during the installation of a fixing sleeve, FIG. 3 shows an enlargement of a part of the jacquard heddle and the fixing sleeve represented in FIG. 1, FIGS. 4 and 5 show two different side views, from mutually perpendicular directions, of the part of the jacquard heddle represented in FIG. 3 with the fixing sleeve provided thereon, of which a front part cut off according to the longitudinal direction has been removed, FIGS. 6 and 7 show the same as FIGS. 4 and 5 in the case that the fixing sleeve provided is a shrink sleeve.

The jacquard heddle (1) represented in the figures consists of a narrow metal strip with, in the proximity of the top extremity, a connecting eye (2) for a harness cord (5). The connecting eye (2) is made as an elongated slot whose top part (4) is smaller than the bottom part (3). The width of the bottom part (3) is greater than the thickness of the harness cord (5) to which the jacquard heddle (1) is connected. The top part (4) of the connecting eye (2) on the other hand has a width which is smaller than the thickness of the harness cord (5).

The top (4) and the bottom part (3) of the connecting eye (2) respectively form the clamping passage (4) and free passage (3) mentioned above in this specification.

The jacquard heddle is further also provided with a widening in which a heddle eye (6) is provided. During weaving on a weaving machine the pile warp threads extend through the heddle eye (6) of respective jacquard heddles (1) of a jacquard machine.

In order to connect the jacquard heddle (1) to a harness cord (5) the free extremity of the harness cord (5) is pulled through the wider slot part (3). This is very easy since this slot part (3) (the free passage) is considerably wider than the thickness of the harness cord (5). Subsequently the jacquard heddle (1) is brought to the correct height for the levelling of the harness. Then the harness cord (5) is pulled upward into the narrower slot part (4). This slot part (4) (the clamping passage) is less wide than the thickness of the harness cord (5), so that the harness cord (5) is clamped in the connecting eye (2) in a fixed position in relation to the jacquard heddle (1).

In order to prevent the harness cord (5) from coming loose out of the clamping passage (4) a fixing sleeve (7) in synthetic material is slid over the jacquard heddle (1). This is represented in FIGS. 1, 2 and 3. This sleeve (7) is brought into a position whereby it encloses the connecting eye (2) and the end part of the harness cord (5) passed around through this connecting eye (2) (see FIGS. 4 and 5).

If this fixing sleeve (7) is made out of a material that can be shrunk after moving the sleeve over (e.g. by heating it) a very good enclosure of the connecting eye (2) and the harness cord (5) can be achieved (FIGS. 6 and 7). Because of this the connection between harness cord (5) and jacquard heddle (1) becomes very operationally safe. Furthermore such a shrink sleeve (7) can also be installed very quickly and easily.

Through this invention the connection of jacquard heddles (1) to harness cords (5) can be performed in a very much simpler manner, faster, and with a greater accuracy than in the past. Making these connections can furthermore also be very well automatized.

What is claimed is:

1. A Jacquard heddle (1) comprising a harness cord and a connecting eye (2) that forms a free passage (3) for the harness cord (5), characterized in that the connecting eye (2) forms a clamping passage (4) in communication with the free passage (3), and that the harness cord (5) can be clamped in the clamping passage (4), wherein the clamping passage is formed by a slot-shaped part (4) of the connecting eye, wherein the connecting eye (2) slot-shaped part extends in a longitudinal direction of the jacquard heddle (1), with two parts (3), (4) of different width which respectively form the free passage (3) and the clamping passage (4).

2. Jacquard heddle (1) according to claim 1 characterized in that the clamping passage (4) is adapted to be narrower than a transverse dimension (6) of the harness cord (5).

3. Jacquard heddle according to claim 1 characterized in that the clamping passage (4) is above the free passage (3).

4. A Jacquard heddle (1) comprising a harness cord and a connecting eye (2) that forms a free passage (3) for the harness cord (5), characterized in that the connecting eye (2) forms a clamping passage (4) in communication with the free passage (3), and that the harness cord (5) can be clamped in the clamping passage (4), wherein the clamping passage is formed by a slot-shaped part (4) of the connecting eye, further comprising a fixing sleeve (7) forming a clamped enclosure for the connecting eye (2) and a part of the harness cord (5) passing around and through the connecting eye.

5. Jacquard heddle according to any of the preceding claims characterized in that the fixing sleeve (7) is a shrink sleeve.

6. A Jacquard heddle (1) comprising a harness cord and a connecting eye (2) that forms a free passage (3) for the harness cord (5), characterized in that the connecting eye (2) forms a clamping passage (4) in communication with the free passage (3), and that the harness cord (5) can be clamped in the clamping passage (4), wherein the clamping passage is formed by a slot-shaped part (4) of the connecting eye, wherein said jacquard heddle is of a flat steel type.

7. Jacquard heddle apparatus comprising a connecting eye for receiving a harness cord, the connecting eye comprising a free passage and a clamping passage communicating with the free passage for receiving and clamping the harness cord, wherein the clamping passage has a cross-section smaller than a cross-section of the free passage, further comprising a fixing sleeve forming a clamped enclosure for the connecting eye and a portion of the harness cord in the connecting eye.

8. Jacquard heddle according to any of the preceding claims characterized in that it is a jacquard heddle of the flat steel type.

9. The apparatus of claim 7, wherein the clamping passage is slot-shaped.

10. The apparatus of claim 7, wherein the connecting eye is a slot extending in a longitudinal direction of the jacquard heddle and having the two passages with different widths.

11. The apparatus of claim 7, wherein the clamping passage is above the free passage.

12. The apparatus of claim 7, wherein the fixing sleeve is a shrink sleeve.

13. The apparatus of claim 7, wherein the jacquard heddle is a flat steel type heddle.

14. Jacquard machine comprising plural jacquard heddles each having connecting eyes and wherein harness cords are connected to a respective jacquard heddle and extend through the respective connecting eye, each connecting eye having a free passage and a clamping passage for a harness cord, wherein the clamping passage has a width less than a width of the free passage for clamping the respective harness cord in the clamping passage, further comprising a fixing sleeve around each jacquard heddle for enclosing the connecting eye and a part of the harness cords passing through the connecting eye.

* * * * *